United States Patent [19]

Bray et al.

[11] 4,155,619

[45] May 22, 1979

[54] ELECTRIC CONTACT CONNECTOR FOR ARMORED COAXIAL CABLE

[75] Inventors: John Bray, Sheffield; Frank Norval, Worthing, both of England

[73] Assignee: Interlemo Holding S.A., Coire, Switzerland

[21] Appl. No.: 868,407

[22] Filed: Jan. 10, 1978

[51] Int. Cl.[2] ..... H01R 17/06

[52] U.S. Cl. ..... 339/177 R

[58] Field of Search ..... 339/177 R, 177 E

[56] References Cited

U.S. PATENT DOCUMENTS

| | | | |
|---|---|---|---|
| 2,958,845 | 11/1960 | Dupre et al. | 339/177 R |
| 3,089,115 | 5/1963 | Wicks | 339/177 R |

FOREIGN PATENT DOCUMENTS

| | | | |
|---|---|---|---|
| 900393 | 7/1962 | United Kingdom | 339/177 E |

*Primary Examiner*—Neil Abrams

*Attorney, Agent, or Firm*—Anthony J. Casella

[57] ABSTRACT

The present invention relates to an electric contact connector for armored coaxial cables. This connector, which comprises a tubular plug-in member in which there is fastened a bushing for holding a contact cable and a clamping element clamped on said bushing around the armoring of said cable, has the special feature that it comprises a single-piece tubular body having, without interruption of continuity, two separate zones one of which constitutes the plug-in element and the other the clamping element. One thus obtains simultaneously the clamping of the armoring and the holding of the cable holding sleeve solely by the clamping operation of the clamping zone of the tubular body.

1 Claim, 2 Drawing Figures

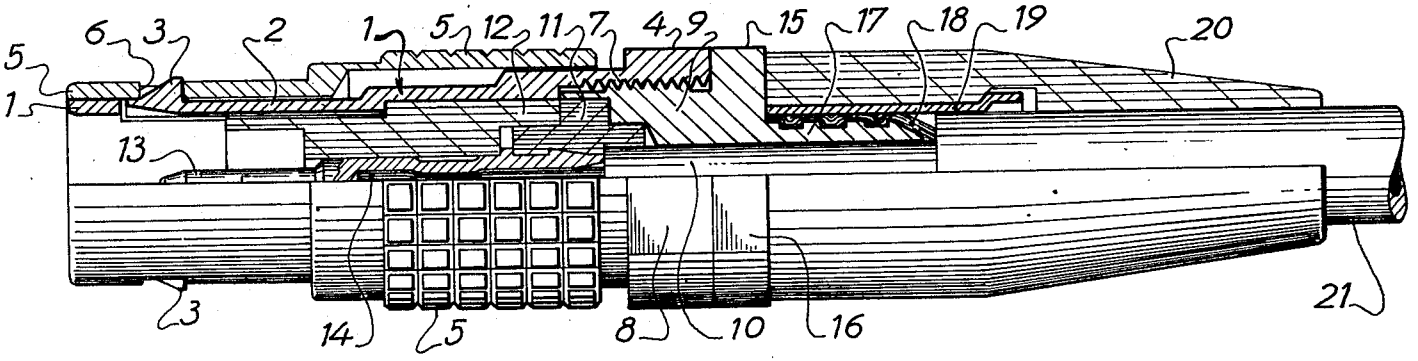
FIG. - 1 - PRIOR ART
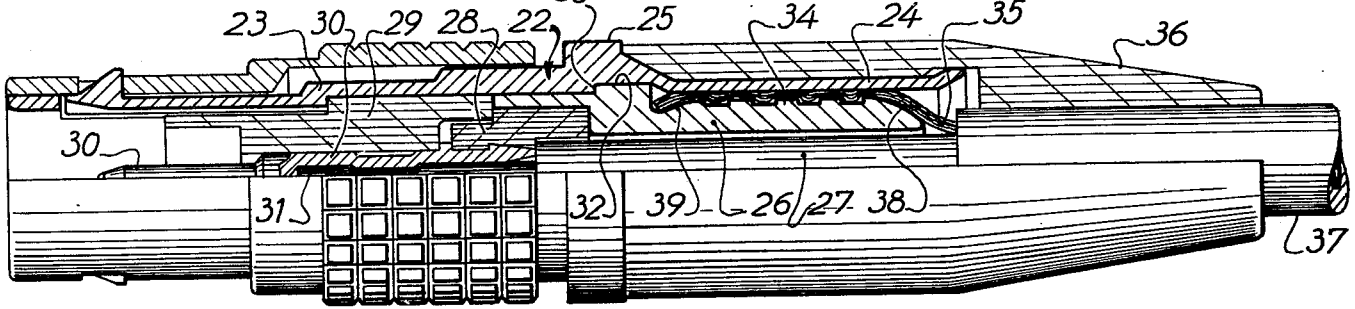
FIG. - 2 -

ELECTRIC CONTACT CONNECTOR FOR ARMORED COAXIAL CABLE

The object of this invention is an electric contact connector for armored coaxial cable having a tubular plug-in element, a bushing for holding a contact cable and its sheathing, fastened within the plug-in element and around which the armoring of said cable is placed, and a tubular clamping element clamped on the bushing around the armoring.

A contact connector of this type is already known in which the bushing for the holding of the contact cable and its sheathing is screwed and locked in an internal thread of the tubular plug-in element and in which the clamping element is formed of a second bushing clamped around the armoring on the first bushing which is screwed into the plug-in element.

It is known that this assembly has the drawback of requiring the use of a large number of parts, which, due to their manner of assembling, requires numerous attachment manipulations and does not assure perfect continuity in the contact of the armoring with the plug-in element.

On the other hand, as the clamping of the armoring must necessarily be gentle in order not to damage the latter, the successive manipulations for the use of this connector may in the long run result in a twisting of the clamping bushing and of the armoring around the holding bushing of the contact cable which, in its turn, is rigidly connected to the plug-in element, and thereby lead to the breaking of the cable by repeated twisting.

In order to avoid these drawbacks, the contact connector in accordance with the invention is characterized by the fact that it comprises a single-piece tubular body having, without interruption of continuity, two separate zones, one of which constitutes the plug-in element and the other the clamping element, so that the armoring is clamped on the holding bushing for the contact cable and the latter is fastened in the tubular body of the connector solely by the clamping operation of the clamping zone of the tubular body.

The accompanying drawing shows a contact connector in accordance with the prior art as well as an embodiment of the contact connector which forms the object of the present invention.

FIG. 1 is a longitudinal view in axial half-section of the known or prior art contact connector.

FIG. 2 is a longitudinal view, in axial half-section, of the contact connector in accordance with the invention.

The known electric contact connector shown in FIG. 1 is an axially locking male connector comprising a tubular plug-in element 1, in the wall of which there are cut longitudinally, 180° from each other, two elastic tongues 2, each of which has a stop notch 3 at its free end. Around this plug-in element 1 there slides over a distance limited by a shoulder 4 a partially knurled ring 5 intended for the operating of the connector and comprising, in the smooth portion of its wall, two openings 6 corresponding to the stop notches 3 and in which the latter are engaged. It may be pointed out here that this known arrangement assures the automatic locking and unlocking of this male connector in a female connector having an annular inner groove intended to retain the stop notches 3.

On the side opposite the tongues 2, the plug-in element 1 comprises an inner thread 7 and the shoulder 4 has two parallel flats 8. In the thread 7 and against the shoulder 4 there is screwed and locked a first threaded bushing 9 intended to hold a contact cable and its sheathing 10 in place via insulating rings 11 and 12 arranged between a spindle 13 in which the bared end 14 of the cable 10 is clamped and the plug-in element 1.

The bushing 9 has a shoulder 15 with two flats 16, similar to those of the plug-in element 1, followed by a cylindrical portion 17 surrounded by circular grooves around which the armoring 18 of the cable 10 is force-fitted.

A clamping element formed of a second bushing 19 is clamped around the armoring 18 on the first bushing 9 screwed into the plug-in element 1.

A protection sleeve 20 covers both the second bushing 19 and the end of an outer sheathing 21 surrounding the armoring 18 of the armored coaxial cable 10.

Upon the connecting of this connector and after the baring of the contact cable 10 and its armoring 18, the second bushing 19 is placed around the outer sheathing 21 and the first bushing 9 is placed around the sheathing of the contact cable 10 at the same time as the armoring 18 is force-fitted over the cylindrical portion 17 of said first bushing 9. Thereupon the spindle 13, equipped with the insulating ring 11, is force-fitted and clamped on the bared end 14 of the cable 10, the insulating ring 11 coming into position in a suitable recess in the first bushing 9, and the second bushing 19 is clamped on the cylindrical portion 17 of the first bushing 9 around the armoring 18. Finally, the last insulating ring 12 is placed around the spindle 13 and the assembly thus formed is engaged in the plug-in element 1 and the latter is screwed onto the first threaded bushing 9 and locked by means of wrenches engaged on the respective flats 8 and 16 of these two parts; the sleeve 20 which has been previously placed around the outer sheathing 21 of the cable is then put in place.

Attention should be called here to the fact that, in addition to the drawbacks already mentioned which arise from the large number of parts constituting this assembly and the interruption in continuity which it presents, there is an additional risk of damage to the conductor cable 10 upon the screwing of the plug-in element 1 on the threaded bushing 9. As a matter of fact, during this screwing operation, the subassembly formed of the insulator 12, the spindle 13, and the bared end 14 of the cable 10 connected to the clamping bushing 9 may be driven along in rotation by the plug-in element 1 either due to burrs or accidental dust or due to a slight defect in alignment, thereby causing a twisting of the conductor 10, in particular at the starting end of its bared portion 14.

The connector in accordance with the invention, which is shown in FIG. 2 is also an axially locking male connector in order clearly to show its distinguishing characteristics from the known connector which has just been described. This connector comprises a tubular body 22 made in a single piece and having, without interruption of continuity, a plug-in zone 23 and a clamping zone 24 separated by a shoulder 25.

This single-piece structure replaces here and performs the same functions as the plug-in element 1 and the clamping element 19, separated by the threaded bushing 9, of the known connector shown in FIG. 1.

The plug-in zone 23 of the tubular body 22 has elastic tongues with stop notches and is surrounded by a knurled ring, these parts being identical to the same parts of the known connector which have already been described.

The new connector also has a bushing 26 intended to hold a contact cable and a sheathing 27 in place via insulating rings 28 and 29 arranged between a spindle 30, in which the bared end 31 of the cable 27 is clamped, and the clamping zone 23 of the tubular body 22.

This bushing 26 has a small shoulder 32 which comes against an annular bearing surface 33 of the tubular body 22, said shoulder 32 following a recess in which the insulating ring 28 is housed and preceding a cylindrical portion 34 which is encircled by circular grooves around which the armoring 35 of the contact cable 27 is force-fitted. The clamping zone 24 of the tubular body 22 is clamped around the armoring 35 on the bushing 26, which also has the effect of holding the bushing 26 firm in the body of the connector, said bushing thus resting on one side against the annular bearing surface 33 and on the other side against the clamping zone 24. A protective sleeve 36 covers the clamping zone 24 and the end of an external sheathing 37 surrounding the armoring 35 of the armored coaxial cable 27.

In order to facilitate the placing of the armoring 35 around the cylindrical portion 34 of the bushing 26 and cause it to assume a good connecting curve, the conical end 38 of said cylindrical portion is imparted a gently curved shape. Finally, the substantial thickness which can in this case be imparted to the bushing 26 makes it possible to produce a groove 39 at the foot of the shoulder 32, connected to the cylindrical portion 34, without creating here any incipient crack, this groove 39 being intended to absorb any possible excess of the material constituting the armoring 35 which is pushed back here at the time of the clamping operation. However, these two details of the bushing 26 are not indispensable in order to obtain the advantages sought.

Made in this manner, the electric contact connector in accordance with the invention offers, as first advantage, a decrease in the number of component parts due to its construction in a single piece, the tubular body 22, the two plug-in and clamping elements, which furthermore assures perfect continuity in the contact of the armoring 35 with the plug-in zone 23.

Thus, upon the connecting of this connector, the risk of damage to the contact cable 17 by twisting is eliminated since the cable holding sleeve 26 is not fastened here by screwing into a plug-in element but is simply fastened in the tubular body 22 of the connector by the sole operation of clamping the clamping zone which also has the function of clamping the armoring 35 on the bushing 26; this latter fact affords the additional advantage of greatly simplifying the connector attachment operations and increasing the reliability thereof.

Finally, it is no longer possible on this connector to cause the armoring 35 to turn with respect to the contact cable 27 during the manipulations in use and to cause in the long run the breaking of the latter by repeated twisting, since the clamping zone 24 is integral with the plug-in zone 23 and therefore cannot come loose angularly, contrary to the known connector, as has been indicated at the beginning hereof.

Of course, the invention is applicable, with all of its advantages, to female connectors and more generally to all electric contact connectors for armored coaxial cable, whether or not they are equipped with an axial locking system.

We claim:

1. Electric contact connector for armored coaxial cable comprising:

(a) a tubular plug-in element having a portion for plug-in engagement with a mating electrical connector;

(b) a bushing means located within said tubular plug-in element for holding the inner conductor and sheathing of a coaxial cable, said bushing means having the armoring of said coaxial cable placed around a portion thereof;

(c) a tubular setting zone formed on a portion of said tubular plug-in element;

(d) an annular bearing surface formed inside said tubular plug-in element, close to said setting zone; and, (e) a shoulder means formed on said bushing means, said shoulder means for resting on one side against said annular bearing surface of said tubular plug-in element and on the other side against said setting zone after the setting thereof, whereby said armoring is set on said bushing means and said bushing means is fastened in said tubular plug-in element by the mere operation of setting of said setting zone of the tubular plug-in element.

* * * * *